United States Patent [19]

de Zeeuw

[11] 4,115,256

[45] Sep. 19, 1978

[54] APPARATUS AND METHOD FOR PARTICLE SEPARATION AND GRADING

[76] Inventor: Hotze Jan de Zeeuw, Suite 143, 9300 Cedar Ave., Minneapolis, Minn. 55420

[21] Appl. No.: 707,446

[22] Filed: Jul. 21, 1976

Related U.S. Application Data

[63] Continuation of Ser. No. 479,644, Jun. 17, 1974, abandoned.

[51] Int. Cl.[2] ..... B03B 1/00

[52] U.S. Cl. ..... 209/3; 209/136; 209/466; 209/474

[58] Field of Search ..... 209/3, 12, 466, 471, 209/133, 477, 138, 139, 131, 477, 467, 472, 136, 137, 134, 135, 479, 480, 481, 36, 37, 469, 468; 55/2

[56] References Cited

U.S. PATENT DOCUMENTS

| | | | |
|---|---|---|---|
| 443,901 | 12/1890 | Craig | 209/135 |
| 619,482 | 2/1899 | Higginbottom | 209/139 R |
| 974,395 | 11/1910 | Kidder | 209/138 X |
| 1,866,951 | 7/1932 | Soulary | 209/467 |
| 2,160,822 | 6/1939 | Bigelow | 209/131 |
| 3,164,548 | 1/1965 | Rowell | 209/139 R |
| 3,308,948 | 3/1967 | Barthelemy | 209/127 R |
| 3,309,569 | 3/1967 | Meyl | 209/127 R X |
| 3,362,414 | 1/1968 | Wochnowski | 209/133 X |
| 3,370,703 | 2/1968 | Carpenter | 209/127 R |
| 3,685,651 | 8/1972 | Grubel | 209/133 |
| 3,738,483 | 6/1973 | Mackenzie | 209/137 |

FOREIGN PATENT DOCUMENTS

| | | | |
|---|---|---|---|
| 213,076 | 6/1956 | Australia | 209/466 |
| 526,040 | 2/1954 | Belgium | 209/138 |
| 407,242 | 12/1924 | Fed. Rep. of Germany | 209/136 |

*Primary Examiner*—Robert Halper
*Attorney, Agent, or Firm*—Wayne A. Silvertson

[57] ABSTRACT

Apparatus and method for separating fly ash into its major constituents; namely, metal, carbon black, cenospheres and dust. The metal is separated by passing the fly ash through a magnetic field at least a part of which has an alternating polarity. The non-magnetic constituent is separated into conductive and dielectric constituents with a high tension separator and the conductive constituent, chiefly cenospheres, is then graded by size. The grading is effected by passing the non-magnetic, conductive fly ash constituent through a cross-flow of ionized air which suspends the cenospheres at different levels according to their weight and size. The apparatus and method has general utility, with obvious modifications, to the grading of particles other than cenospheres.

18 Claims, 5 Drawing Figures

APPARATUS AND METHOD FOR PARTICLE SEPARATION AND GRADING

This is a continuation of application Ser. No. 479,644, filed June 17, 1974, now abandoned.

BACKGROUND OF THE INVENTION

It is well known that the combustion of solid fuel, such as coal, produces fine particles of non-combusted materials which are carried out of the fuel bed by the draft. These particles are typically called fly ash. In large installations, such as power plants, the fly ash is collected by means of electrical precipitators which are known to the prior art. Briefly, electrical precipitators have negative electrodes and grounded collecting plates. A negative charge is placed on the fly ash particles by the negative electrodes causing them to be attracted to the collecting plates. In theory, contact of the charged particles with the collecting plates neutralizes the particles causing them to fall from the collecting plates to a point where they are vacuumed into a storage tank. Separation of the particles from the collecting plates may be assisted by vibrating the collecting plates.

It has been recently determined that cenospheres are a major constituent of fly ash. The fly ash cenospheres are chemically inert hollow spheres having a diameter up to approximately 300 microns. They are composed chiefly of silicon oxide, aluminum oxide and iron oxide with nitrogen in their void. Heretofore, such spheres have been made commercially, principally for use in reflectors and as buoyancy devices in deep diving submarines. The high cost of their manufacture has severely limited their application to other uses. However, the cost of fly ash cenospheres is only that of separating from the other fly ash constituents and, with an efficient system for separating and grading fly ash cenospheres, many other uses are envisioned. For example, cenospheres may be employed as heat insulators and fillers for plastics and rubber. Other cenosphere uses are being examined.

The present method of separating fly ash cenospheres is to place the fly ash in holding ponds where the cenospheres rise to the surface because of their buoyancy. They are then dried and marketed. However, the cenospheres obtained in this manner include dust particles as well as small carbon black particles. In examining the residue at the bottom of the holding ponds it has also been determined that a great portion of the cenospheres are trapped at the bottom of the ponds. It is believed that this results from the fact that the fly ash collected with electrical precipitators is highly charged causing the cenospheres, dust and carbon black to cling together in clusters causing many of the cenospheres to sink while those that do not sink have dust and carbon black particles clinging to their surface.

The highly charged character of the fly ash has been established by examination of the fly ash prior to the placing it in the holding pond. Many factors are believed to contribute to this charge. For example, a build up of fly ash on the collecting plates reduces the ability of the collecting plates to electrically neutralize the fly ash. Also, movement of the fly ash particles relative to each other produces a static electricity build up in the particles while the flue gases passing through the collecting system ionizes those gases bringing about coulombic forces.

BRIEF DESCRIPTION OF THE PRESENT INVENTION

The highly charged nature of the collected fly ash renders the holding pond system of cenosphere collection very inefficient. In addition, this system does not have the ability to recover metallic particles contained within the fly ash. The present invention provides apparatus and a method for separating fly ash to its major constituents; namely, metal, carbon black, cenospheres and dust. Although the relative amount of each of the constituents is dependent upon the fuel being burned and the installation in which the combustion takes place, it can be expected that the metal and cenosphere constituents will compose from 60 to 80 percent of the fly ash with carbon black, commonly referred to as loss on ignition, generally within the range of 0.5 to 12% of the fly ash. The remaining constituents may be regarded as dust.

The apparatus and method of the present invention recovers the metal from the fly ash by passing the fly ash through a magnetic field at least a part of which has an alternating polarity. The non-magnetic constituent is then separated into conductive and dielectric constituents by a high tension separator and the conductive constituent, chiefly cenospheres, is then graded by size. Thus, the metal and carbon black (the dielectric constituent separated by the high tension separator) are recovered by the fly ash. The remaining constituent is chiefly cenospheres containing some dust.

The cenosphere grading is effected by passing the nonmagnetic, conductive fly ash constituent through a cross-flow of ionized air which suspends the cenospheres at different levels according to their weight which is dependent on their size. This grading is performed in a chamber which is ducted at the top for the removal of dust. The apparatus and method of the present invention, and particularly the grading apparatus and method, have general utility, with obvious modifications, to the grading of particles other than cenospheres.

DETAILED DESCRIPTION OF THE DRAWINGS

It should be understood that the term metal, as used herein, is intended to encompass those materials which exhibit magnetic properties. Also, the term fly ash is intended to include not only the material produced by the combustion of a solid fuel but, also, the fly ash constituents intended for further processing in accordance with the present invention. That is, the term fly ash may be employed to describe the material which is separated into conductive and dielectric constituents after the removal of the magnetic constituent as well as the nonmagnetic, conductive constituent which is graded according to particle size. In addition, all constituents are identified by their major component and that identification is not intended to imply that any constituent is 100% pure or that the separation accomplished by the present invention is 100% effective.

Figure 1:
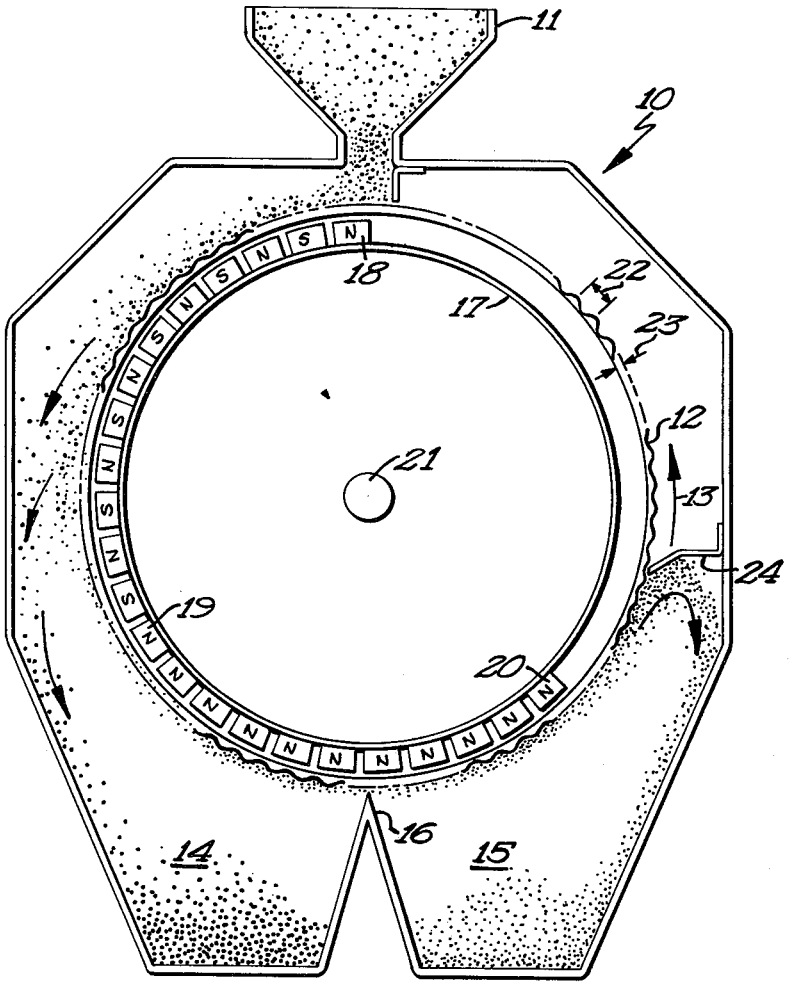
FIG. 1 is a diagrammatic illustration of the metal recovery apparatus of the present invention.

Referring now to FIG. 1, there is shown the metal recovery apparatus of the present invention. A closed chamber 10 is provided with a hopper 11. The fly ash is loaded into the hopper from which it drops to a rotating cylinder 12 which rotates in the direction of the arrow 13. The chamber 10 is provided with two collecting areas 14 and 15 separated by a splitter 16. A stationary member 17 underlies the rotating cylinder 12 and is provided with magnets over a portion of the circumference of the rotating cylinder 12. As illustrated, the magnets are bar magnets which are positioned from a point just under the hopper 11 around the circumference of the cylinder 12 to a point past the splitter 16. The magnets are arranged with an alternating polarity from the magnet 18 to the magnet 19 and with a constant polarity from the magnet 19 to the magnet 20. Of course, magnets other than bar magnets may be employed consistent with the provision of contiguous portions of alternating and constant polarity, as illustrated. The change from alternating to constant polarity may be made at any point slightly above or below the axis of rotation 21 to the cylinder 12.

The cylinder 12 is provided with a corrugated surface and is preferably constructed from a non-magnetic material such as plastic. It may be formed of a corrugated sheet whose ends are joined to form the cylinder 12. When constructed in this manner, and before joining the ends to form the cylinder, the peak to peak distance 22 may be approximately equal to the difference in height 23 between a peak and a recess. Of course, when the ends are joined to form a cylinder the peak to peak distance 22 will become larger.

In operation, fly ash from the hopper 11 will fall onto the rotating cylinder 12 and will be carried with that cylinder in the direction of the arrow 13. As discussed above, the highly charged nature of the fly ash will cause the fly ash particles to form clusters including the magnetic or metal particles. The alternating polarity as the fly ash moves from the magnet 18 to the magnet 19 will cause a change in orientation of the magnetic particles which serves to break up the clusters and prevent entrapment of non-magnetic materials within a recess of the corrugated cylinder 12. In addition, the corrugated nature of the surface of the cylinder 12 will produce a rolling motion in the clusters and the particles themselves thus facilitating the cluster break up and release of the non-magnetic materials from the surface of the cylinder 12. The non-magnetic particles will fall from the surface of the cylinder 12 into the compartment 14 while the magnetic particles will be held to the cylinder 12 by the constant polarity magnet portion defined by the magnet 19 and the magnet 20. After passing the magnet 20, the magnetic particles will be released from the cylinder 12 to fall within the compartment 15. Any magnetic particles which do not release themselves will be scraped from the cylinder 12 by a flexible blade 24 in known manner.

Figure 2:
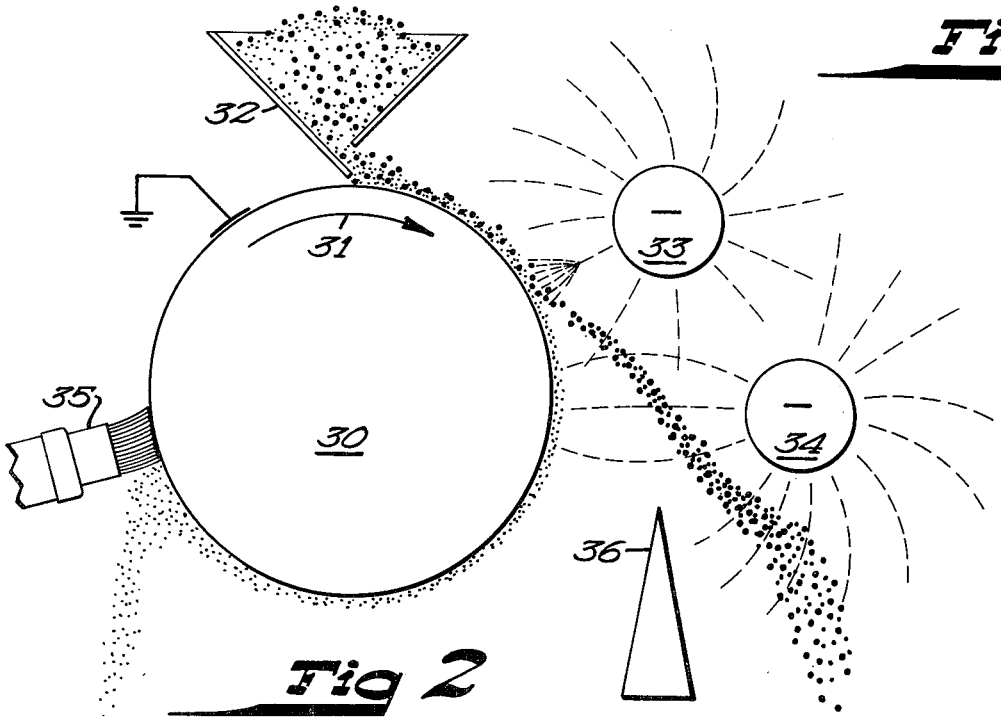
FIG. 2 is a diagrammatic illustration of a high tension separator which may be employed in the practice of the present invention.

The metals (magnetic materials) separated from the non-magnetic materials may be further processed, in known manner, to recover metals. The non-magnetic fly ash constituent recovered in the compartment 14 will be further processed as illustrated in FIG. 2. It has been found in some cases that the electrostatic forces existing on the fly ash are too great for an efficient metal separation as illustrated in FIG. 1. In such cases, a prior bombardment of the fly ash with a static eliminator using, for example, a nuclear material such as Polomium 210, or by a generator producing a high concentration of small ions will eliminate enough of the static charge on the fly ash to obtain a concise separation.

Referring now to FIG. 2, there is shown a high tension separator which is employed in the present invention to separate the fly ash into conductive and dielectric constituents. High tension separators are known to the prior art and may be employed as illustrated or with the polarity reversed, as is well known. A grounded rotor 30 rotates in the direction of the arrow 31. A hopper 32 feeds the fly ash to the grounded rotor which rotates it past an ionic electrode 33. All the fly ash particles are charged by the ionic bombardment from the ionic electrode 33 causing the breakdown of any clusters resulting from static charges. The conductive particles share their charge with the grounded rotor 30 and are thus in a nuetral electrical state. The dielectric materials, however, cannot share their charge and are pinned by their image force to the grounded rotor 30. Further rotation of the rotor 30 brings the fly ash particles under the influence of a static electrode 34 which attracts the electrically neutral conductive materials. The dielectric materials remain on the rotor 30 to a point where they are removed from the rotor by a brush 35, for example. A splitter 36 may be employed to separate the conductive and dielectric fly ash constituents from each other in a manner similar to that illustrated with reference to the splitter 16 in FIG. 1.

Assuming that the metal-magnetic constituent has been removed from the fly ash placed in the hopper 32, the high tension separator illustrated in FIG. 2 will essentially separate carbon black from the cenospheres. In relative terms, the cenospheres are conductive and the carbon black is dielectric. Of course, if the operation of FIG. 2 is conducted before that of FIG. 1, the conductive constituent will include the metal-magnetic constituent as well as the cenospheres while the dielectric constituent will remain essentially carbon black.

To this point there has been discussed the separation of metal and carbon black from fly ash. Both of these materials have economic value far greater than the value of fly ash with those constituents intermingled. However, the greatest economic benefit from the apparatus and method of the present invention resides in the separation of the cenospheres from the fly ash and their grading according to size. That is, the larger cenospheres generally have a greater economic value than the smaller cenospheres or a mixture of cenospheres without regard to size. Thus, the remaining discussion will center on the grading of cenospheres by size and the independent collection of dust. It is to be understood, however, that the grading apparatus and method may be applied, with obvious modifications, to grade any particles by size where their size has a reasonably consistent relationship with weight.

Figure 3:
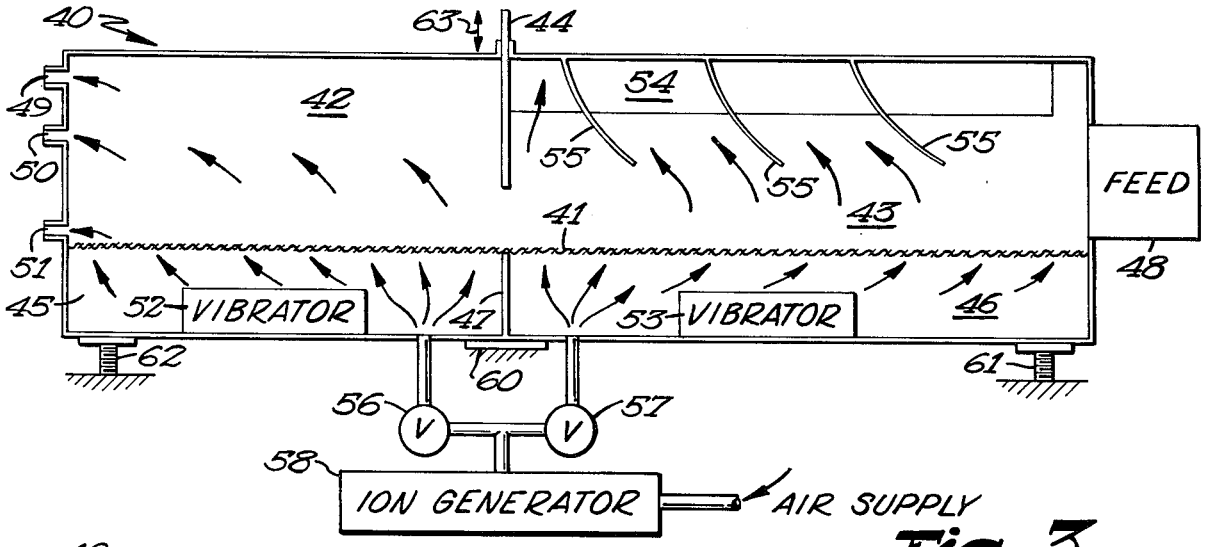
FIG. 3 is a diagrammatic illustration of the particle grading apparatus of the present invention.

Referring now to FIG. 3, there is shown the particle grading apparatus of the present invention. A pressure chamber 40 is divided into upper and lower compartments by an air distributing fabric 41. The upper compartment is divided into sections 42 and 43 by a gate 44 while the lower compartment is divided into sections 45 and 46 by a plate 47. The section 42 of the upper compartment is preferably coextensive with the section 45 of the lower compartment as is the case with the sections 43 and 46. A particle feeding device 48 is mounted in the section 43 and particle collecting ducts 49, 50 and 51 are connected into the end wall of the section 42. A vibrator 52 is provided for the sections 42 and 45 and a vibrator 53 is provided for the sections 43 and 46. The section 43 of the upper compartment is provided with a duct 54 which draws air from the top of the section 43 and vanes 55 whose function will be explained more fully below. An air supply (not shown) provides air under pressure to the sections 45 and 46. The pressure in the sections 45 and 46 can be independenty controlled through valves 56 and 57 and all the air passed to these sections 45 and 46 is ionized by an ion generator 58. The particles to be graded are introduced to the chamber 40 by the feed mechanism 48. In order to induce a flow of those particles for collection at the ducts 49, 50 and 51, it is necessary that at least the air distributing fabric 41 have a slope from a point adjacent the feed mechanism to a point adjacent the collecting ducts. The slope of the air distributing fabric 41 may be established by sloping the entire chamber 40. For reasons to be explained, it is preferable that the slope of the air distributing fabric 41 in the section 43 be greater than the slope in the section 42. To accomplish this, the junction of the two sections of the chamber 40 may be commonly supported, as at 60, while the ends may be adjustably supported as at 61 and 62. By proper adjustment of the members 61 and 62, the required slope in the air distributing fabric 41 can be accomplished with that slope being less in the section 42 than in the section 43.

The feed mechanism 48 is of the type which will introduce the particles into the section 43 while maintaining a pressure seal. Prior art devices for accomplishing this purpose are known, an example of which is a rotary feeder. Air under pressure is introduced into the section 46 via the valve 57. The air distributing fabric 41 serves to establish a uniform pressure within the section 46 thereby providing an even flow of air through the fabric. It has been found that cloths having a porosity of between 1 to 1.2 c.f.m. as indicated at ½ inch of water pressure across the fabric provides the required distribution of air within the section 46 and an adequate flow of air through the fabric 41. The air passing through the fabric 41 creates a cross-flow relative to the direction of movement of the particles introduced by the feed mechanism 48. That is, the particles move from the feed mechanism 48 in a direction toward the ducts 49–51 as a result of the slope in the fabric 41 and the air flow is generally across the direction of movement of the particles. This cross-flow suspends the particles at a level dependent on their size and weight, the lighter particles being suspended at a higher elevation. Inasmuch as the non-magnetic, conductive fly ash constituent contains a significant amount of dust, those dust particles are suspended at the highest elevation and are directed by the vanes 55 to the duct 54 where they are removed from the chamber 40. The gate 44 is moveable as indicated by the arrow 63 and may be used to control the size of the particles which move into the section 42. For example, by raising the gate 44 smaller particles are allowed to pass while lowering of the gate 44 blocks those smaller particles causing them to be removed from the chamber 40 via the duct 54. In the cenosphere grading application of the present invention, it is anticipated that the gate 44 will be set at a height which allows particles more than one micron is diameter to pass into section 42. Particles of approximately one micron and smaller are carried with the air through the duct 54.

The vibrator 53 produces a vibration in the air distributing fabric 41. This vibration prevents clogging of the pores of the fabric 41 and facilitates the movement of the heavier particles which may not be suspended by the cross-flow of air. In addition, vibration of the air distributing fabric 41 creates pressure waves which produces a scrubbing action in the heavier suspended particles. This scrubbing action serves to break up any clusters of cenospheres and clusters of cenospheres and dust. However, the scrubbing action, as well as the general movement of the particles themselves, may result in the build up of a static charge in the particles. To negate the effects of this static charge build up, the air which passes through the air distributing fabric 41 is ionized by the ion generator 58.

As described above, the particles being graded go through an initial grading and cleaning process in the section 43. That is, particles smaller than a certain size are removed from the system via the duct 54, including dust and those particles too small to be of significant economic value. In addition, the action of the vibrator and ionization of the air aids the break up of any clusters resulting from static electrical charges thereby making a concise grading possible. The particles remaining after the initial grading and cleaning in section 43 pass to the section 42 under the gate 44. The vibrator 52 sets up a vibration in the air distributing fabric 41 for reasons similar to the vibration established in that fabric via the vibrator 53. Also, the air passing through the fabric 41 into the section 42 is ionized by the ion generator 58 for reasons similar to the ionization of the air passing into the section 43.

The slope of the air distributing fabric 41 in the section 42 is less than the slope of the fabric in the section 43 inasmuch as the number of particles entering this section 42 is less than the number of particles entering the section 43 and a slower movement of the particles relative to the fabric 41 is desirable in order to maintain a continuous system. Within the section 42, the particles are again subjected to a crossflow of ionized air which tends to support them at an elevation established by their size and weight. Inasmuch as the size range of the particles in the section 42 is different from that in the section 43, the air flow into the section 42 is independently controlled via the valve 56. Thus, it is possible to suspend the smaller particles in the section 42 at the height of the duct 49 while those particles could be suspended in the section 43 only to a height at or below the bottom of the gate 44. It is apparent from the arrows indicating the direction of air flow in the section 42 that the air flow is not strictly a crossflow. It is to be understood, however, that the term cross-flow, as used herein, is intended to cover a flow in a direction having a significant component in the direction perpendicular to the movement of the particles such that the particles are suspended above the fabric 41 in accordance with their size and weight. Thus, within the section 42 the particles are suspended by a cross-flow of air according to their size and weight and pass to the ducts 49–51 where they are withdrawn.

The section 42 is illustrated with three ducts 49–51. It is to be understood that any number of ducts may be employed and their position will be determined by the desired size increments in the graded particles. That is, two ducts may be employed to grade the particles into large and small constituents. A third duct may be interposed to provide an intermediate sizing. Additional ducts may be added, as desired, dependent on the nature of the grading desired. Also, inasmuch as the non-magnetic, conductive fly ash constituent introduced by the feed mechanism 48 may contain heavy, noncenosphere particles there should be one duct connected as illustrated at 51 to withdraw those particles from a point at or slightly above the height of the air distributing fabric 41. It has been found that these heavier particles contain a significant amount of metal and improperly formed cenospheres which may be further processed for recovery of any valuable components.

Figure 4:
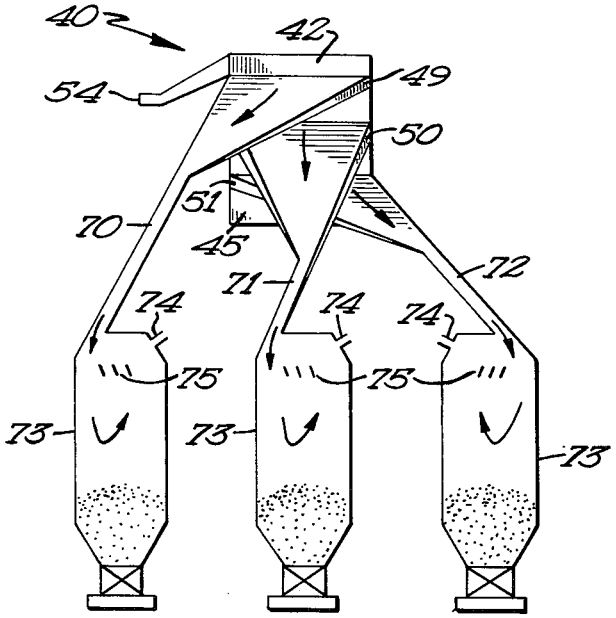
FIG. 4 illustrates particle collecting apparatus which may be employed with the embodiment of FIG. 3.

Referring now to FIG. 4, there is shown an end view of the chamber 40 with the sections 43 of the upper compartment and 45 of the lower compartment being indicated. As illustrated, the ducts 49–51 extend across the full width of the section 43 and taper to restricted portions 70, 71 and 72. The restricted portions 70–72 are intended to provide a flow restriction so that the pressure within the chamber 40 may be maintained. Alternatively, valves may be employed to control the flow restriction and maintain the pressure without the chamber 40. The particles collected by the ducts 49–51 pass to particle collectors 73 which collectors are provided with venting ducts 74 and baffles 75. The particles entering the collectors 73 fall to the bottom of those collectors while the air carrying them to the collectors is vented through the duct 74. The baffle 75 prevents the flow of the particles from the collector 73 through the vent 74. The bottom of the collector 73 may be appropriately valved to allow removal of the particles. The duct 54 connected into the section 43 may be similar to any one of the ducts 49–51 including the restriction to maintain pressure within the section 43.

Figure 5:
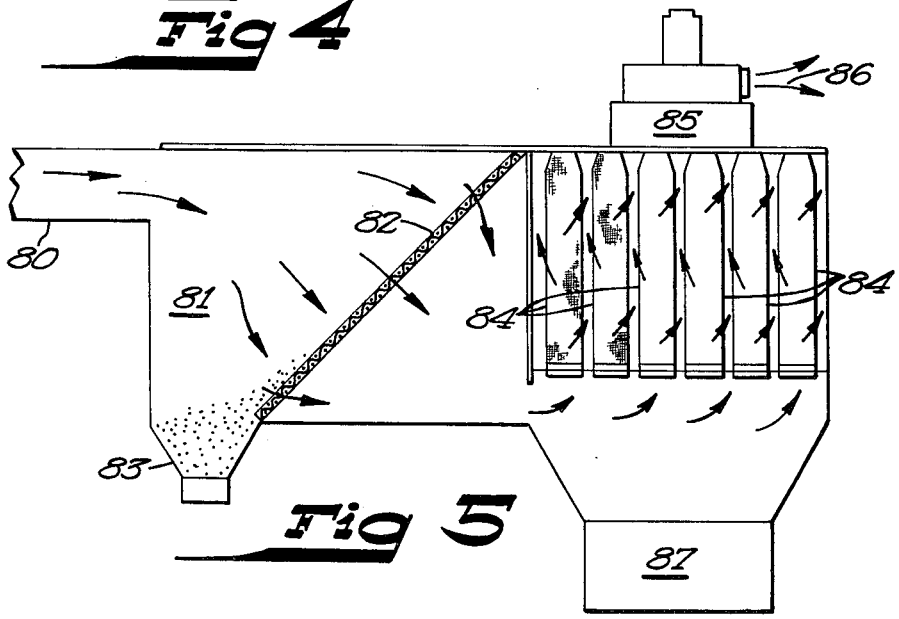
FIG. 5 illustrates a dust collection system which may be employed with the present invention.

Inasmuch as some dust may be included within the graded particles and withdrawn from the chamber 40 by the ducts 49-51, the exhaust 49 may be connected to a dust collecting mechanism such as that illustrated in FIG. 5. Also, the duct 54 from section 43 should be connected to a dust collecting device, the two dust collecting devices being common for economy. Such a device is illustrated in FIG. 5. The duct 80 is connected to duct 74 and duct 54 and opens into a chamber 81. A pulsating screen 82 blocks the larger particles which fall into a collecting bin 83. The smaller particles which pass by the pulsating screen 82 are blocked by the bags 84 which are attached to a blower 85 which passes air to the atmosphere as indicated at 86. The dust blocked by the bags 84 falls into a dust collector 87 from which it may be removed and disposed of. Of course, the dust collecting mechanism of FIG. 5 need not be employed in those instances where a discharge of dust into the atmosphere does not violate acceptable environmental practices.

As described, the present invention has particular utility in separating fly ash into the identified constituents. Of course, obvious modifications render the present invention useful in any particle grading application. For example, in the embodiment of FIG. 3 the ion generator 58 may be dispensed with in those applications where a static charge build up is not likely. Additionally, the nature of the particles being graded may allow the grading operation to take place without the vibrators 52 and 53. Similarly, if it is not desirable to dispose of the smaller particles and/or if there is no dust in the particles being graded, the duct 54, vanes 55 and gate 44 may be dispensed with. It is therefore to be understood that, within the scope of the appended claims, the invention may be practiced otherwise than as specifically described.

What is claimed is:

1. Apparatus for grading the non-magnetic, conductive constituent of fly ash which comprises:

pressure chamber means;

air distributing means spanning said pressure chamber means and forming first and second compartments therein;

adjustable gate means dividing said second compartment into first and second sections;

means for dividing said first compartment into first and second sections coextensive with said second compartment sections;

air supply means connected to each section of said first compartment and providing an upward cross-flow of air in each section of said second compartment through said air distributing means for suspending the particles to be graded at different levels within said cross-flow in accordance with their size and weight, said air supply means being independently controllable for each first compartment section and including ionizing means;

means for feeding the non-magnetic, conductive fly ash constituent into the first section of said second compartment;

means for collecting the graded non-magnetic, conductive fly ash constituent from the second section of said second compartment at a minimum of two levels in said cross-flow each level being spaced from the other and said air distributing means in said cross-flow, said air distributing means having a downward slope from said feeding means to said collecting means with the slope in each pressure chamber section being independently adjustable;

means for establishing a vibration in said air distributing means; and duct means in the first section of said second compartment for removing those particles of the non-magnetic, conductive fly ash constituent which are smaller than a predetermined size.

2. Particle grading apparatus which comprises:

pressure chamber means;

air distributing means spanning said pressure chamber means and forming first and second compartments therein;

gate means dividing said second compartment into first and second sections, said gate means comprising adjustable means;

means for dividing said first compartment into first and second sections coextensive with said second compartment sections;

air supply means connected to each section of said first compartment and providing an upward cross-flow of air in each section of said second compartment through said air distributing means for suspending the particles to be graded at different levels within said cross-flow in accordance with their size and weight, said air supply means being independently controllable for each first compartment section;

means for feeding the particles to be graded into the first section of said second compartment;

means for collecting the graded particles from the second section of said second compartment at a minimum of two levels in said cross-flow each level being spaced from the other and said air distributing means in said cross-flow, said air distributing means having a downward slope from said feeding means to said collecting means; and duct means in the first section of said second compartment for removing those particles which are smaller than a predetermined size.

3. The apparatus of claim 2 further comprising means for producing a vibration in said air distributing means.

4. The apparatus of claim 3 further comprising means for independently adjusting the slope of said air distributing means within each pressure chamber section.

5. The apparatus of claim 2 wherein said air supply means is provided with ionizing means.

6. A particle grading method comprising the steps of:

introducing the particles into a first chamber, at least the floor of the first chamber having a downward slope from the particle introduction point;

suspending the particles in a generally uniform upward flow of air through the first chamber floor at levels established by particle size and weight;

removing from said first chamber, at a point spaced from the particle introduction point, those particles which are smaller than a predetermined size;

introducing those particles which remain after said removing step into a second chamber, at least the floor of said second chamber having a downward slope from the particle introduction point;

suspending the particles in a generally uniform upward flow of air through the second chamber floor at levels established by particle size and weight, the second chamber flow of air being independent of the first chamber flow of air;

collecting the particles at a plurality of levels in the second chamber flow of air at a point spaced from the second chamber particle introduction point; and ionizing at least one of said first and second chamber upward flows of air.

7. The method of claim 6 further comprising the step of vibrating at least one of said first and second chamber floors.

8. The method of claim 7 wherein said first and second chamber floors each comprise a fabric and the steps of suspending comprise the step of establishing a pressure, higher than the respective chamber pressure, on the fabric and outside of the chambers.

9. The method of claim 6 further comprising the step of vibrating at least one of said first and second chamber floors.

10. The method of claim 6 wherein said first and second chamber floors each comprise a fabric and the steps of suspending comprise the step of establishing a pressure, higher than the respective chamber pressure, on the fabric and outside of the chambers.

11. Particle grading apparatus which comprises:

pressure chamber means;

air distributing means spanning said pressure chamber means and forming first and second compartments therein;

gate means dividing said second compartment into first and second sections;

means for independently adjusting the slope of said air distributing means within each pressure chamber section;

means for dividing said first compartment into first and second sections coextensive with said second compartment sections;

air supply means connected to each section of said first compartment and providing an upward cross-flow of air in each section of said second compartment through said air distributing means for suspending the particles to be graded at different levels within said cross-flow in accordance with their size and weight, said air supply means being independently controllable for each first compartment section;

means for feeding the particles to be graded into the first section of said second compartment;

means for collecting the graded particles from the second section of said second compartment at a minimum of two levels in said cross-flow each level being spaced from the other and said air distributing means in said cross-flow, said air distributing means having a downward slope from said feeding means to said collecting means; and duct means in the first section of said second compartment for removing those particles which are smaller than a predetermined size.

12. The apparatus of claim 11 further comprising means for producing a vibration in said air distributing means.

13. The apparatus of claim 11 further comprising means for producing a vibration in said air distributing means.

14. The apparatus of claim 11 wherein said gate means comprises adjustable means.

15. Particle grading apparatus which comprises:

pressure chamber means;

air distributing means spanning said pressure chamber means and forming first and second compartments therein;

gate means dividing said second compartment into first and second sections;

means for dividing said first compartment into first and second sections coextensive with said second compartment sections;

air supply means connected to each section of said first compartment and providing an upward cross-flow of air in each section of said second compartment through said air distributing means for suspending the particles to be graded at different levels within said cross-flow in accordance with their size and weight, said air supply means being independently controllable for each first compartment section and including ionizing means;

means for feeding the particles to be graded into the first section of said second compartment;

means for collecting the graded particles from the second section of said second compartment at a minimum of two levels in said cross-flow each level being spaced from the other and said air distributing means in said cross-flow, said air distributing means having a downward slope from said feeding means to said collecting means; and duct means in the first section of said second compartment for removing those particles which are smaller than a predetermined size.

16. The apparatus of claim 15 further comprising means for producing a vibration in said air distributing means.

17. The apparatus of claim 15 wherein said gate means comprises adjustable means.

18. The apparatus of claim 15 further comprising means for independently adjusting the slope of said air distributing means within each pressure chamber section.

* * * * *

UNITED STATES PATENT AND TRADEMARK OFFICE

CERTIFICATE OF CORRECTION

PATENT NO. : 4,115,256

DATED : September 19, 1978

INVENTOR(S) : Hotze Jan de Zeeuw

It is certified that error appears in the above-identified patent and that said Letters Patent are hereby corrected as shown below:

Column 5, line 66, delete "is" and insert --in--.

Column 7, line 20, delete "without" and insert --within--.

Claim 13 should be deleted to appear as follows:

--The apparatus of claim 11 wherein said air distributing means comprises a fabric.--

Signed and Sealed this

*Third* Day of *April 1979*

[SEAL]

*Attest:*

RUTH C. MASON
*Attesting Officer*

DONALD W. BANNER
*Commissioner of Patents and Trademarks*